US008860568B1

(12) United States Patent
Baker

(10) Patent No.: US 8,860,568 B1
(45) Date of Patent: Oct. 14, 2014

(54) HOME FLOOR SAFE SECURITY SYSTEM

(71) Applicant: Aaron M. Baker, Claremont, CA (US)

(72) Inventor: Aaron M. Baker, Claremont, CA (US)

( * ) Notice: Subject to any disclaimer, the term of this patent is extended or adjusted under 35 U.S.C. 154(b) by 0 days.

(21) Appl. No.: 13/694,606

(22) Filed: Dec. 17, 2012

(51) Int. Cl.
*G08B 23/00* (2006.01)
*G08B 13/22* (2006.01)

(52) U.S. Cl.
CPC ..... *G08B 13/22* (2013.01)
USPC ..... 340/517; 340/506; 340/507; 340/521; 340/3.1

(58) Field of Classification Search
USPC ..... 340/506, 507, 517, 521, 3.1
See application file for complete search history.

(56) References Cited

U.S. PATENT DOCUMENTS 5,400,246 A * 3/1995 Wilson et al. ..... 700/17
6,759,957 B2 7/2004 Murakami et al.
7,561,019 B2 7/2009 Sasakura et al.
7,786,891 B2 8/2010 Owens et al.
7,847,675 B1 12/2010 Thyen et al.
8,032,934 B2 10/2011 Chen et al.
8,037,531 B2 10/2011 Yeom
8,049,613 B2 11/2011 Poder
8,108,684 B2 1/2012 Addy

* cited by examiner

*Primary Examiner* — Daryl Pope
(74) *Attorney, Agent, or Firm* — Gordon K. Anderson

(57) ABSTRACT

A security system for monitoring alarming situations inside of a home security safe and communicating alarm activation is taught which consists of a central processor, that receives input, processes sensed situations, stores information and provides an output alarm. A number of event detecting sensors, an IP surveillance camera and an electric circuit switch provide input into the central processor. Wireless communication and a memory activity log of keypad usage input are also provided. Output from the processor sends information to a central station, having an alarm enunciator and battery backup. Information is sent through a land line, or WIFI/wireless circuit, to a central monitoring station. There are two embodiments differing only in the interconnection between functional elements. A hard wired embodiment for OEM construction and a wireless WIFI embodiment is for after-market installation.

5 Claims, 3 Drawing Sheets

HOME FLOOR SAFE SECURITY SYSTEM

CROSS REFERENCE TO RELATED APPLICATION

This application claims priority of Provisional Patent Application Ser. No. 61/634,920 filed Mar. 9, 2012.

TECHNICAL FIELD

The present invention relates to a security system for monitoring alarming situations inside of a home security safe and communicates alarm activation to a central monitoring station.

BACKGROUND ART

Previously, many types of security systems have been used in endeavoring to provide an effective means to secure a home a business or similar buildings as well as office equipment etc. from intrusion and theft.

The prior art listed below did not disclose patents that possess any of the novelty of the instant invention; however the following U.S. patents are considered related:

| Pat. No. | Inventor | Issue Date |
|---|---|---|
| 6,759,957 B2 | Murakami et al. | Jul. 6, 2004 |
| 7,561,019 B2 | Sasakura et al. | Jul. 14, 2009 |
| 7,786,891 B2 | Owens et al. | Aug. 31, 2010 |
| 7,847,675 B1 | Thyen et al. | Dec. 7, 2010 |
| 8,032,934 B2 | Chen et al. | Oct. 4, 2011 |
| 8,037,531 B2 | Yeom | Oct. 11, 2011 |
| 8,049,613 B2 | Poder | Nov. 1, 2011 |
| 8,108,681 B2 | Addy | Jan. 31, 2012 |

Murakami et al. in U.S. Pat. No. 6,759,957 B2 teaches a home security system which includes sensors that detect an alarming situation in different locations inside a facility, cameras capture images inside and a controller memorizes the associations between sensors. When any of the sensors detect an alarming situation the controller updates and memorizes the associations.

U.S. Pat. No. 7,561,019 B2 issued to Sasakura et al. is for a security system capable of safely performing home device state check or operation. A mobile telephone module transmits data to a home device such as door lock and home electrical appliances. In response the mobile telephone authenticates the home device and returns a state check. When mutual authentication is complete the mobile telephone is notified.

Owens et al. in U.S. Pat. No. 7,786,891 B2 disclose a system and method for displaying video in a residence. An indication of the alert is received as communicated from a security system of a residence. The indication of the alert is communicated to a cellular telephone. A selection of a television indicated for the cellular telephone is received. The television selected from multiple televisions located within the residence. A command is communicated to display one or more images on the selected televisions.

Thyen et al. in U.S. Pat. No. 7,847,675 B1 teaches a security system for monitoring, controlling and automating one or more work areas and office furniture components, or monitoring, controlling utility components in other environments such as retail, restaurant, and home applications. The system includes passive and active access authentication devices as storage components, offices and worksites. The system includes a processor and access authentication device, sensors for monitoring work areas, actuators for controlling and automating work areas and status and alarm notifiers.

U.S. Pat. No. 8,032,934 B2 issued to Chen et al. is for a network security system including a firewall arranged between the internal network and the external network and a trusted node arrange between the firewall and the external network. Data is provided between the internal network and the external network. The firewall includes a first port configured at the internal network oriented side of the firewall and a second port configured at the external network oriented side of the firewall. The trusted node includes a media stream receiving port used to converge the data from the second port.

Yeom in U.S. Pat. No. 8,037,531 B2 discloses a dynamic network security system in a router where an intrusion detection system and a voice over internet protocal application level gateway are integrated. The voice over internet protocal application level gateway module acquired information as a counterpart unit for determining intrusion detection on a packet received with the voice over internet protocal application level gateway counterpart unit.

U.S. Pat. No. 8,049,613 B2 of Poder discloses a security system used in a home, office or other building in order to generate alarms or take other actions depending on conditions within the building. The security system relies on sensors within the building which sense various conditions and collect data. The information learned from the sensor is communicated to a location outside the building for processing, such as but not limited to, processing associated with the need to investigate an alarm. For background purposes and as indicative of the art to which the invention is related reference may be made to the remaining cited patent issued to Addy in U.S. Pat. No. 8,108,681 B2.

DISCLOSURE OF THE INVENTION

A security system increases the safekeeping of a floor safe of the type used to store valuables in the home, such as firearms, jewelry and important documents. The present invention accomplishes this object by utilizing a central processor that receives input, processes sensed situations, stores information and provides an output alarm. A number of event detecting sensors, an IP surveillance camera and an electric circuit switch provide input into the central processor. Wireless communication and a memory activity log of keypad usage input are also provided.

The description of the devices and the functions of the inventions are summarized as follows:

Separate devices communicate with a central processer/wireless bridge and are processed and communicate with a remote central station, or a PC web based smart phone.

Communications are modes between devices not limited to: wireless RF, WIFI and hard wired.

A central processor/wireless bridge communicates with each device and can communicate via a remote central station, PC, web based or smart phone application.

A central station is used for optional communication to and offsite central monitoring station via wireless cellular of land line.

An IP camera may be externally mounted or an internally built-in camera or a combination of both.

A vibration/tilt sensor monitors vibration and or tilting of the safe and sends a signal to the central processor/wireless bridge for processing.

A wireless transceiver is used for additional device signals and for strengthening devices signals to the central processor/wireless bridge for processing.

A USP port antenna is used for sending and receiving WIFI or RF signals.

A water/humidity sensor senses the presents of water or humidity inside the safe and sends a signal to the central processor/wireless bridge for processing.

A keypad and lock accesses the safe keypad and lock and monitors the input keypad and sends a signal to the central processor/wireless bridge for processing permitting access via web based smart phone and remote operation. A memory card is used for additional storage of use.

A door locked sensor monitors the condition of the door and sends a signal to the central processor/wireless bridge for processing, and A door locked sensor monitors the locked condition of the door and sends the signal to the central processor/wireless bridge for processing.

A door open/closed sensor monitors the condition of the door and sends the signal to the central processor/wireless bridge for processing.

There are two embodiments of the invention differing only in the interconnection between functional elements. A hard wired embodiment is for OEM construction and a wireless or WIFI embodiment is for aftermarket installation.

This and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
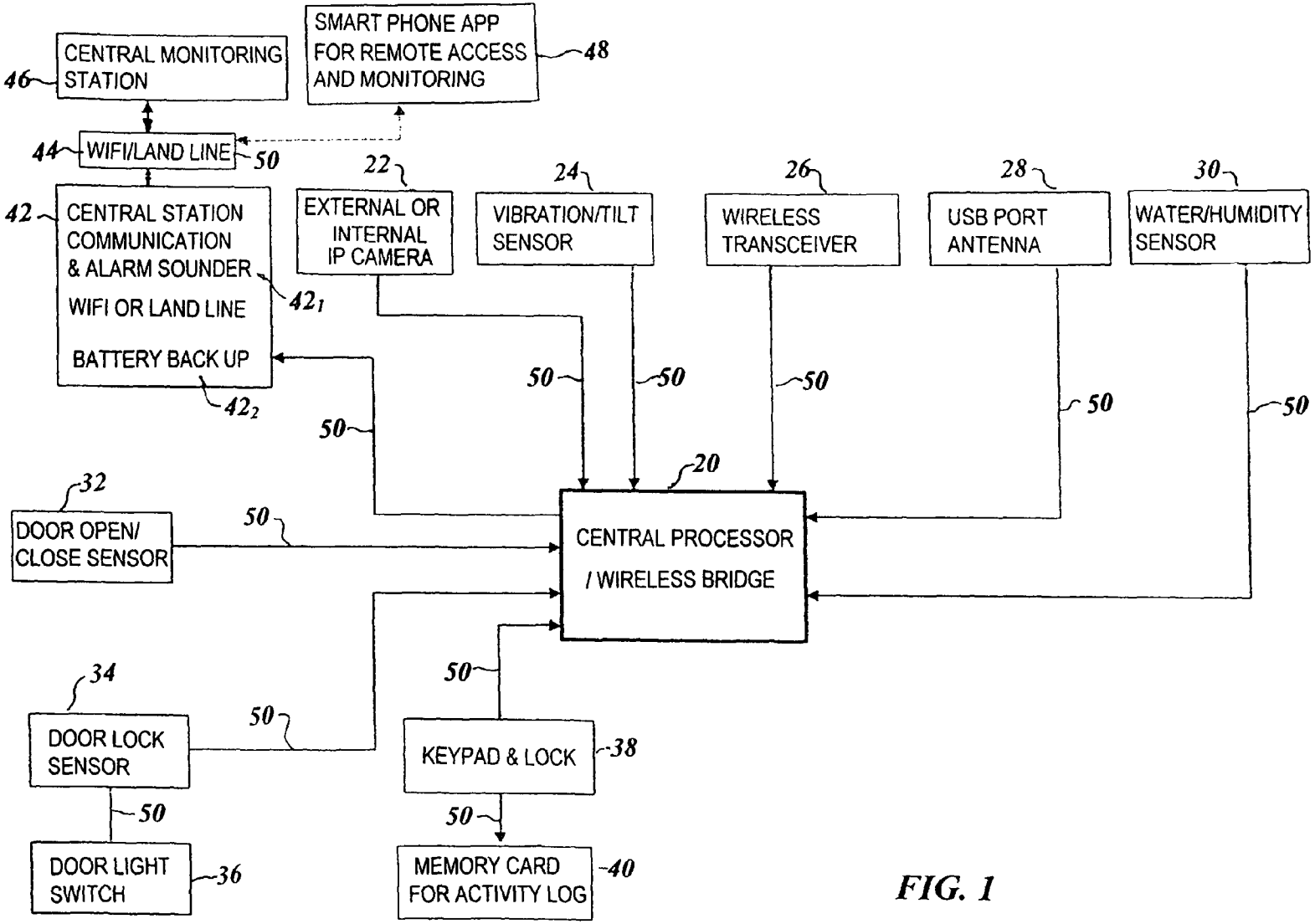
FIG. 1 is a block diagram of the security system for monitoring alarming situations inside of a home security safe in the hard wired embodiment.
Figure 2:
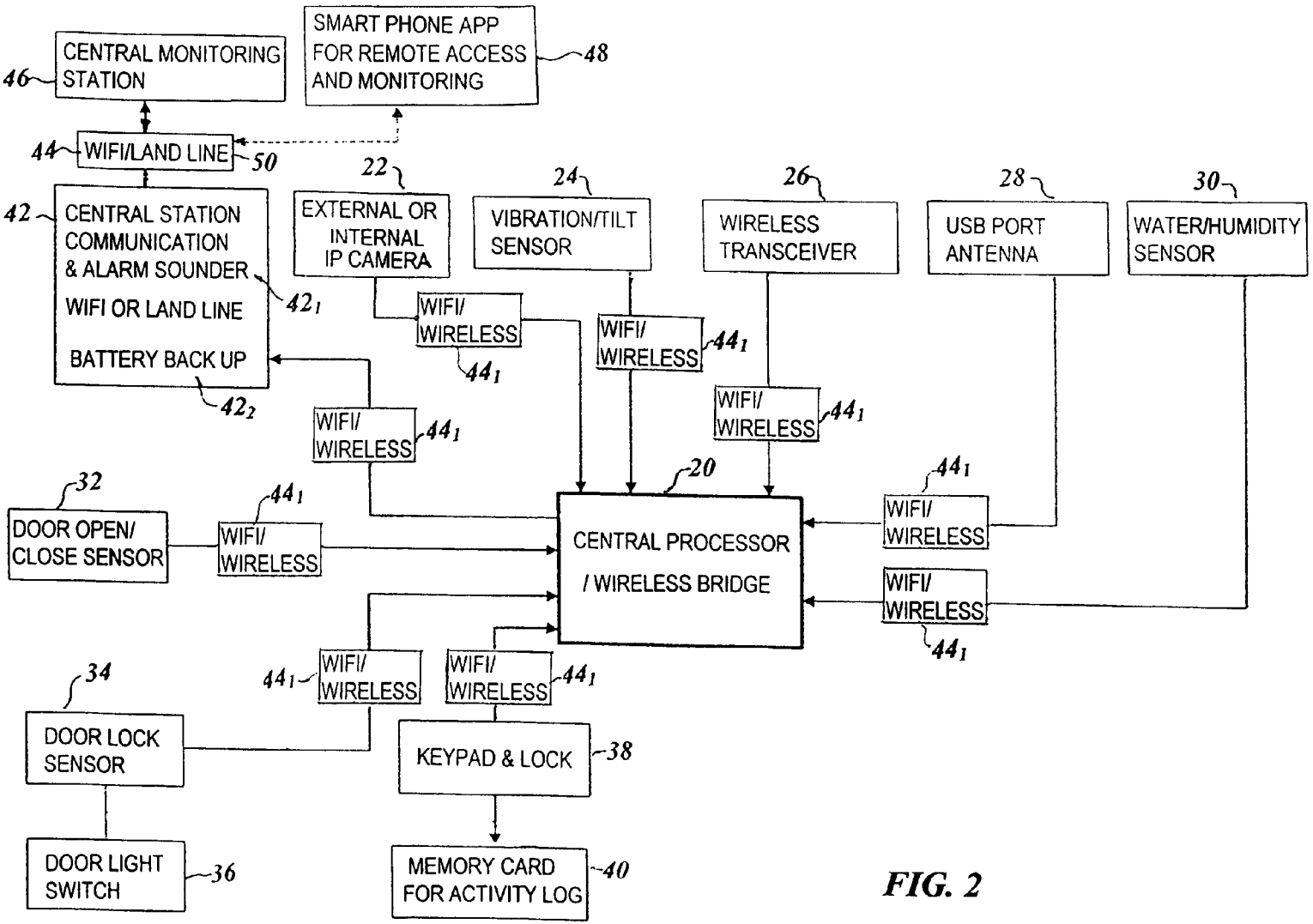
FIG. 2 is a block diagram of the security system for monitoring alarming situations inside of a home security safe in the wireless WIFI embodiment.

The best mode for carrying out the invention is presented in terms of two embodiments which differ in the interconnection between functional elements. The hard wired embodiment is shown in FIG. 1 and the wireless embodiment is illustrated in FIG. 2, with FIG. 3 associated with both embodiments.

The security system 10 for monitoring alarming situations inside or outside of a home security safe 12 and communicates alarm activation for both embodiments which consists of a central processor/wireless bridge 20, hereafter designated central processor, that receives input, processes sensed situations, stores information and provides an output alarm. The central processor 20 is preferably a programmable microprocessor, well known in the art, for authentication and processing of information.

A plurality of event detecting sensors provide input into the central processor 20, such as, but not limited to the following;

A vibration/tilt sensor 24 located within the home security safe 12, preferably on a vertical wall, A water/humidity sensor 30 positioned on the inside floor surface in a location were water would likely accumulate, A door lock position sensor 34 situated adjacent to the door lock of the home security safe 12, sending a signal to the central processor 20 the status of an open or closed position of the door lock, and A door open/close sensor 32, placed opposite the door hinge side, such that when the door was opened, even only slightly, the sensor would respond.

Figure 3:
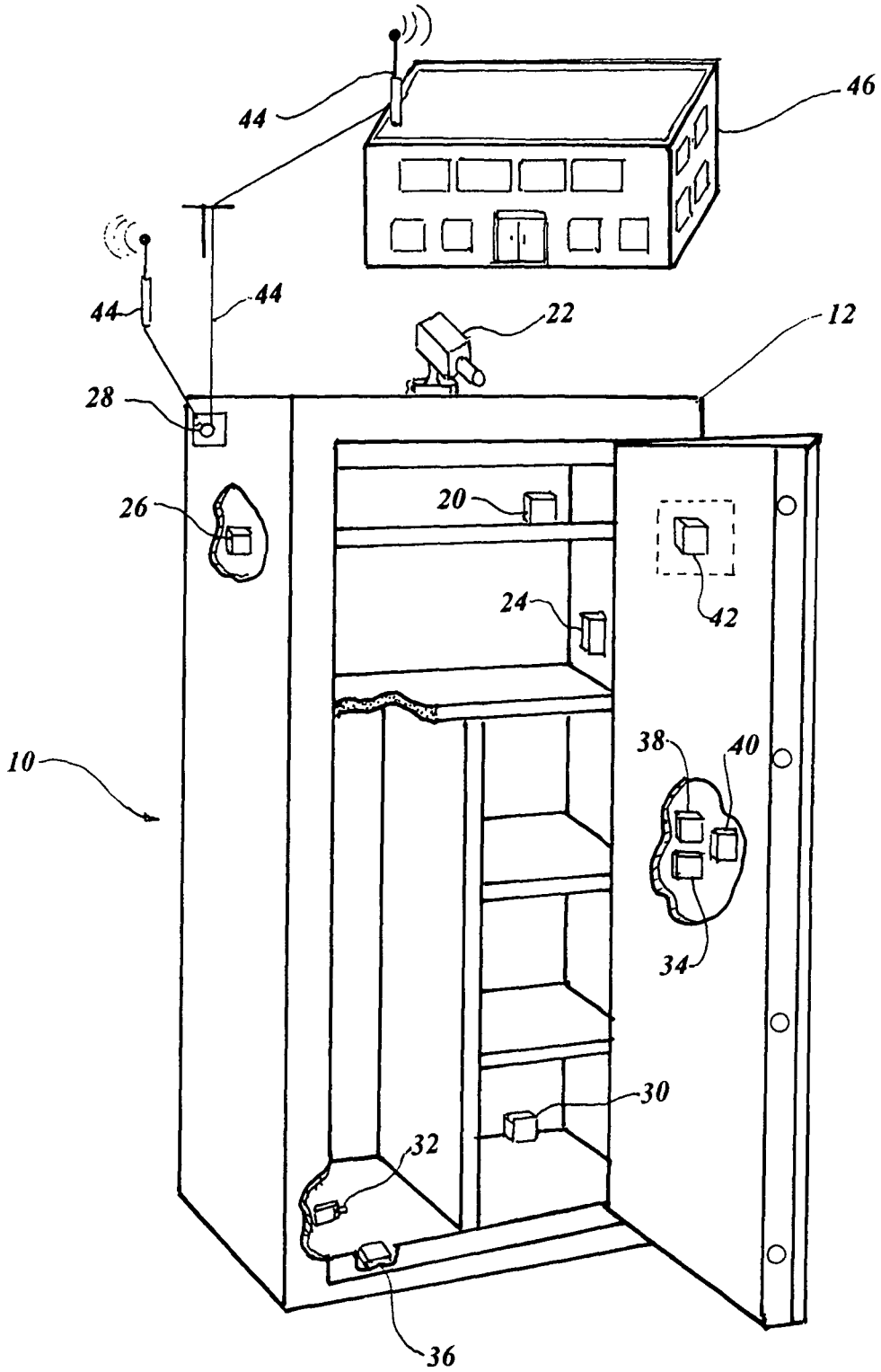
FIG. 3 is a partial isometric view of a typical home security safe with the system elements illustrated inside and outside of the safe in a possible location but not limited to the location shown as other positions would also function satisfactorily.

At least one IP surveillance camera 22 providing image data input to the central processor 20. The surveillance camera 22 is the internet protocol (IP) type that includes information indicating the specific date and time of the image data such that the memory unit of the central processor 20 corresponds to the request from the central monitoring station 46 or other security-related surveillance sources at home or a business using a computer, cell phone or the like. The surveillance camera 22 is shown in FIG. 3 as being located on top of the home security safe 12; however it may be located inside the safe 12 instead achieving the same end result.

The central processor 20 may receive input from an electric circuit door light switch 36 for turning on a door lights inside the home security safe 12. The switch 36 may be any type however a push button snap switch type is preferred positioned in such a manner as to be energized only when the door is opened.

Input is also received to the central processor 20 in the form of means for wireless communication, defined as both a wireless transceiver 26 and a USB port antenna 28 for receiving and sending information.

A memory activity log of keypad usage is received as input to the central processor 20 as well as a memory card 40 is provided within the keypad and lock 38 of the safe 12.

A power source is provided to power the central processor 20 with either mains city power, battery power or a combination of both.

The hard wired 50 embodiment illustrated in FIG. 1 connects the input to the central processor 20 using a wireline which could include copper wire, coaxial cable, fiber optic, or hybrid fiber coaxial cable. This hard wired 50 embodiment is preferably accomplished by the original equipment manufacturer.

The wireless embodiment illustrated in FIG. 2 connects the input to the central processor 20 using wireless transmission over one way or two way wireless RF such as WIFI, WiMax, GSM, CDMA, Z-wave (908 MHz), ZigBee (2.4 GHz), 433 MHz protocol, spectrum: 400 MHz to 5 GHz or the like, with WIFI preferred which may be employed in aftermarket kits that are easily assembled by the owners of the safe.

The central processor 20 provides output to the central station 42, which includes an alarm enunciator $\mathbf{42}_1$ in the safe door and an integral battery backup $\mathbf{42}_2$ in the form of a plurality of storage batteries. A smart phone App 48 interfaces between the central processor 20 and the central monitoring station 46 for access and monitoring.

A land line/WIFI 44 is utilized to send information from the central station 42 to a central monitoring station 46 which may be a security-related surveillance service, a home, a business which may use a computer or a cell phone for observation.

FIG. 2 depicts the wireless embodiment which differs from FIG. 1 in that the interconnection of elements with hard wire lines 50 is accomplished with wireless WIFI $\mathbf{44}_1$.

FIG. 3 illustrates a specific location of the elements within the security safe 12 shown in the block diagrams of FIGS. 1 and 2, however the locations are only arbitrary as they may be positioned differently according to the size and model of the safe and still be within the scope of the patent.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A security system for monitoring alarming situations related to a home security safe and communicating alarm activation which comprises;

a) central processor, receiving input, processing sensed situations, storing information and providing output alarm, b) plurality of event detecting sensors providing input into said central processor, c) at least one IP surveillance camera providing input into said central processor, d) an electric circuit switch providing input into said central processor, e) a memory activity log of keypad usage input to said central processor, f) means for communication to said central processor, wherein said means for communication to said central processor further comprises hard wiring consisting of an electronic circuit with said central processor having:

(1) a first input connected to a keypad and a lock circuit, (2) a second input connected to a door lock sensor, (3) a third input connected to a door open/close sensor, (4) a fourth input connected to an IP camera, (5) a fifth input connected to a vibration/tilt sensor, (6) a sixth input connected to a transceiver, (7) a seventh input connected to a USB port antenna, (8) a eighth input connected to a water/humidity sensor, and said central station connected to an output supplied by said central processor, g) a power source for said central processor, h) processed output information from said central processor transmitted to a central station having an alarm enunciator and battery backup, i) a land line receiving information from said central station as well as a smart phone App for access and monitoring, and j) a central monitoring station receiving information from said central station through said a land line communicating alarm activation for alarming situations.

2. The security system for monitoring alarming situations as recited in claim 1 wherein said keypad and lock circuit has and output that is connected to a memory card.

3. The security system for monitoring alarming situations as recited in claim 1 wherein said door lock sensor is activated by a switch.

4. The security system for monitoring alarming situations as recited in claim 1 wherein said central station interfaces with a central monitoring station.

5. A security system for monitoring alarming situations related to a home security safe and communicating alarm activation which comprises;

a) central processor, receiving input, processing sensed situations, storing information and providing output alarm, b) plurality of event detecting sensors providing input into said central processor, c) at least one IP surveillance camera providing input into said central processor, d) an electric circuit switch providing input into said central processor, e) a memory activity log of keypad usage input to said central processor, f) means for communication to said central processor, wherein said means for communication to said central processor further comprises a WIFI/wireless circuit connected between said central processor and:

a) said keypad and lock circuit, b) said door lock sensor, c) said door open/close sensor, d) said central station, e) said IP camera, f) said vibration/tilt sensor, g) said transceiver, h) said USB port antenna, and i) said water/humidity sensor, g) a power source for said central processor, h) processed output information from said central processor transmitted to a central station having an alarm enunciator and battery backup, i) said WIFI wireless circuit receiving information from said central station as well as a smart phone App for access and monitoring, and j) a central monitoring station receiving information from said central station through said WIFI wireless circuit communicating alarm activation for alarming situations.

* * * * *